United States Patent [19]

Solovieff

[11] 4,012,929

[45] Mar. 22, 1977

[54] LATCH CONSTRUCTION WITH IMPROVED ANTI-VIOLATION FEATURES

[75] Inventor: Paul G. Solovieff, Tustin, Calif.

[73] Assignee: Emhart Industries, Inc., Farmington, Conn.

[22] Filed: May 19, 1976

[21] Appl. No.: 687,989

[52] U.S. Cl. ..... 70/134; 70/381; 70/417; 292/139

[51] Int. Cl.[2] ..... E05B 9/04; E05C 1/06

[58] Field of Search ..... 292/25, 96, 106, 337, 292/139, 357, DIG. 53, DIG. 54, DIG. 61, 26, 36, 48; 70/118, 119, 120, 129, 131, 133, 134, DIG. 53, DIG. 54, 379, 380, 381, 471, DIG. 42, 417

[56] References Cited

UNITED STATES PATENTS

| | | | |
|---|---|---|---|
| 2,296,020 | 9/1942 | Carter | 292/139 |
| 2,811,384 | 10/1957 | Schmid | 292/357 |
| 2,962,320 | 11/1960 | Gilbert | 292/337 |
| 3,101,965 | 8/1963 | Muttart | 292/357 |
| 3,136,572 | 6/1964 | Lytle | 292/357 X |
| 3,677,593 | 7/1972 | Wahlberg | 292/357 X |
| 3,699,788 | 10/1972 | Gerlach | 292/139 X |
| 3,702,549 | 11/1972 | Solovieff | 292/139 X |

*Primary Examiner*—J. Franklin Foss
*Attorney, Agent, or Firm*—Mahoney, Schick & Cislo

[57] ABSTRACT

A bolt is reciprocally extended and retracted in a door by a latch driving mechanism operably connected to exterior and interior operator assemblies projecting from a mounting opening between faces of the door. A pair of inwardly dished reinforcing plates edge abut the door faces spanning the door opening and the exterior operator assembly is secured inwardly against its respective reinforcing plate by primary fastening screws engaged with a lock frame of the exterior operator assembly, through the latch driving mechanism and end secured in the opposite interior reinforcing plate. If a hand actuated interior operator assembly is used, the interior operator is rotatably mounted on the interior cover which is secured to the interior reinforcing plate by secondary fastening screws endwise secured in the primary fastening screws, but if the interior operator assembly includes a lock, the interior operator assembly is secured inwardly against the interior reinforcing plate by the lock frame being similarly engaged by secondary fastening screws. In the latch driving mechanism, a pair of longitudinally extending driving levers are rearwardly operably connected to the exterior and interior operators and forwardly pivotally connected within a rearwardly opening bolt cavity to the bolt for movement thereof. The rearward ends of the driving levers are movably guided along latch frame guide surfaces by pin connection therewith, retention against such guide surfaces being maintained by a spring constantly resiliently urging the driving lever forward ends downwardly about their pivotal connection to the bolt. The spring is C-shaped positioned between the driving levers with an upper leg bearing upwardly against the bolt and a lower leg resting downwardly against the bolt pivot pin and terminating rearwardly thereof with downward engagement in slots of the driving levers.

18 Claims, 6 Drawing Figures

LATCH CONSTRUCTION WITH IMPROVED ANTI-VIOLATION FEATURES

BACKGROUND OF THE INVENTION

This invention relates to a latch construction and more particularly, to improved anti-violation features incorporated in such latch construction. According to certain of the anti-violation improvements of the present invention, increased reinforcing for the latch exterior operator is provided resulting in more secure fastening thereof, as well as a more complete guarding against the obtainment of access to the interior working parts of the latch. In addition, and according to other anti-violation improvements of the present invention, a spring of the latch driving mechanism has been replaced with a uniquely shaped and connected form thereof which more completely insures that when the bolt is moved completely into its extended position, the bolt will be securely retained in such extended position against any possibility of dislodging the same other than by intended operation of the latch in the normal manner.

Although the anti-violation improvements disclosed and claimed herein are applicable to many forms of latch constructions, one of the principal uses thereof is as improvements to the latch constructions disclosed in the prior U.S. Pat. No. 3,699,788, issued Oct. 24, 1972. Generally, the latch construction disclosed in said prior patent is of the dead bolt type and one form thereof includes a hardened guard collar in at least the exterior operator assembly thereof to prevent shearing of the lock frame of the exterior operator assembly, particularly at the door surface, in order to prevent violation of the latch construction. In order to augment the anti-shearing qualities of this hardened guard collar in the exterior operator assembly, it is also preferred to mount the hardened guard collar rotatable relative to the remainder of the exterior operator assembly so that, upon attempted cutting or similar attack on the surfaces of this hardened guard collar, the same will rotate to aid in frustrating such attempts.

Although this hardened guard collar in the exterior operator assembly is quite efficient in frustrating shearing attacks on the latch construction, it has been found that even greater anti-violation security for the latch construction can be provided if surreptitious access to the internal working parts of the latch construction is more effectively prevented. Eliminating the possibility of shearing of the exterior operator assembly as discussed above, the only possible means of access to the internal working parts of the latch construction is at the exterior face of the door within which such latch construction is mounted. Violation attempts can be made by attempting to insert tools along the exterior door face and behind or at the inner side of the exterior operator assembly and greater security at this particular location is a part of the anti-violation improvements of the present invention.

Still another possible means of attempting to violate latch constructions generally including the latch construction hereinbefore discussed is the loosening and possible ultimate destruction of the fastening means retaining the latch construction mounting with the particular door. Again, the attempted attack must necessarily be against the exterior operator assembly at the outer surface of the door within which the latch construction is mounted. In the subject latch construction, as with most latch constructions, the exterior operator assembly is secured by fastening screws threadably received in the lock frame of the exterior operator assembly, through the internal latch driving mechanism and engagement in the interior operator assembly thereby securely clamping the exterior and interior operator assemblies against the appropriate exterior and interior door faces with the latch driving mechanism therebetween.

Thus, despite anti-shearing and other anti-violation protection incorporated in the particular latch construction as to frustrating attacks on the exterior operator assembly, all of these are of little value if it is possible to loosen and dislodge the exterior operator assembly from the door exterior face or surface by merely partially destroying the clamping effect of the fastening screws. Obviously, attack on the latch construction fastening screws can be by the use of tools inserted along the exterior door face or surface and behind the exterior operator assembly as hereinbefore discussed, but if effective anti-violation shielding is provided at this particular location, the required secure clamping effect of the fastening screws may still be disturbed merely by a disturbance of the clamping engagements of the fastening screws with the exterior and interior operator assemblies. That is, the clamping effect of the fastening screws between the exterior and interior operator assemblies and against the respective door faces is not only dependent on the fastening means engagement with the exterior operator assembly which can be relatively easily shielded against attack, but, more importantly, is also dependent on the engagement of the fastening means with the interior operator assembly including the structural strength of the interior operator assembly at the location of such engagement.

Most prior latch constructions including the prior latch construction herein improved make use of a pair of fastening screws which are installed from the door interior face peripherally head engaged with the cover of the interior operator assembly and, as hereinbefore described, through the latch driving mechanism and threadably into the exterior operator assembly so that the described clamping effect of these fastening screws is most importantly dependent on the strength of the engagement in the interior operator assembly. In one form of the prior improved latch construction, an interior guard collar is installed beneath the cover of the interior operator assembly directly underlying the fastening screw head clamping against the cover and edge engaging the door interior surface. Although this interior guard collar only provides clamping strengthening for fractional outer parts of the heads of the clamping screws and not around the total peripheries of these screw heads, it does serve to provide some increased clamping strength for the cover of the interior operator assembly and through such cover these small parts of the clamping screw heads.

The principal lacking of this interior guard collar concept of the prior construction is the lack of full engagement with the fastening screw heads, as described, only engageably supporting relatively small parts of the fastening screw heads. Secondly, increased clamping strength provided by the interior guard collar is through the cover of the interior operator assembly, the interior guard collar must necessarily conform to the shape of the cover thereby greatly limiting cover designs. Still further, if it is desired to incorporate a lock frame and lock cylinder in the interior operator assembly replacing a hand actuated interior operator thereof, the interior guard collar must be completely eliminated and it becomes a problem as to just how the equivalent clamping strength can be incorporated into the lock frame mounting against the door interior face. The solution of these various problems is again an important improvement of the present invention.

As hereinbefore pointed out, the prior latch construction within which the improvements of the present invention may be advantageously incorporated is of the dead bolt type and this prior construction incorporates an important feature for dead bolt security wherein, once the dead bolt has been fully extended, for instance, from the door edge and into fully extended engagement with the door jamb strike plate, the bolt is positively retained or dogged in such extended position and positively resisting forces thereagainst tending to drive the same back into retracted position. This is accomplished by providing a pair of driving levers of the latch driving mechanism which are forwardly pivotally connected to the bolt to produce the bolt movement having rearward ends movably guided along guide surfaces terminating forwardly in downwardly projecting end slots. As the bolt is moved by these driving levers from retracted to extended position, the driving lever rearward ends are guided along these guide surfaces until the bolt reaches its fully extended position, at which time, the guiding for the driving lever rearward ends is downwardly into engagement within the downwardly projecting end slots thereby generally resisting bolt rearward movement from fully extended position except by operation of the latch driving mechanism.

In order that the guiding of the driving lever rearward ends will positively move downwardly into and remain downwardly positioned within the downwardly projecting end slots upon movement of the bolt into its fully extended position, a spring is provided at the forward ends of the driving levers where these levers are pivotally connected to the bolt which constantly resiliently urges lever downward pivoting. This means that the driving levers are always resiliently urged to pivot downwardly relative to the bolt to retain the lever rearward guiding at all times against the guide surfaces and, most importantly, positively moving and positively retained in the bolt rearward movement resisting downwardly projecting end slots. This resilient urging by the spring, therefore, is obviously a vital key in this extended bolt retention or dogging feature and certain of the improvements of the present invention deal with providing a more positively actionable spring.

OBJECTS AND SUMMARY OF THE INVENTION

It is, therefore, an object of this invention to provide a latch construction with improved anti-violation features, certain of which deal with improved exterior and interior operator assembly clamping of the latch against the appropriate exterior and interior door faces for more positively frustrating violation attacks directed against and through the exterior operator assembly. According to certain of the principles of the present invention, the exterior operator assembly is more securely clamped against the exterior door face and over the opening through the door within which the latch driving mechanism is mounted by securing the interior ends of the fastening means to an interior reinforcing plate positioned transversely spanning the interior end of the door opening and edge abutting the interior door face resulting in the clamping of the exterior operator assembly against the exterior door face being completely independent of the cover and the interior operator of the interior operator assembly. The cover and the interior operator of the interior operator assembly are separately secured to the fastening means independent of the fastening means securement to the interior reinforcing plate having nothing to do with the strength of the exterior operator assembly securement and regardless of the particular form of the remainder of the interior operator assembly.

The overall result is that greater securement strength for the exterior operator assembly is obtained by this independent clamping, and the separate fastening of the remainder of the interior operator assembly permits a free choice and free interchangeability of the interior operator, that is, a hand operated interior operator rotatably mounted in a cover with the cover independently secured to the fastening means or an interior lock assembly independently secured with the cover to the fastening means. Furthermore, this increased security of clamping of the exterior operator assembly may be augmented by the incorporation in the exterior operator assembly of a similar exterior reinforcing plate similarly positioned and against which the remainder of the exterior operator assembly is clamped by the fastening means. This not only provides the greater strength of securement by the exterior and interior reinforcing plates acting one against the other in the fastener means clamped assemblies, but with the increased clamping strength taken in combination with the exterior reinforcing plate providing greater shielding for the latch internal parts, a maximum combined anti-violation protection results.

It is an additional object of this invention to provide a latch construction with improved anti-violation features wherein certain of the anti-violation improvements deal with latch constructions specifically of the dead bolt type and relating to a more positive retainment or dogging of the dead bolt in its fully extended position as hereinbefore discussed. According to these improved anti-violation features of the present invention, a unique form of spring is installed in the latch driving mechanism replacing the spring formally intended to serve the function of insuring the dead bolt retainment or dogging. This spring is of a compression spring type, as opposed to the former leaf spring type, and in its preferred form, is positively retained in assembly and against any possible accidental displacement which could destroy the functioning qualities thereof. In this manner, not only is more positive dead bolt retainment or dogging in the bolt extended position obtained, but complete assurances are given that such will be true over a long period of useful life so as to again add to the anti-violation improvements of the present invention.

Other objects and advantages of the invention will be apparent from the following specification and the accompanying drawings which are for the purpose of illustration only.

DESCRIPTION OF THE BEST EMBODIMENTS CONTEMPLATED

Figure 1:
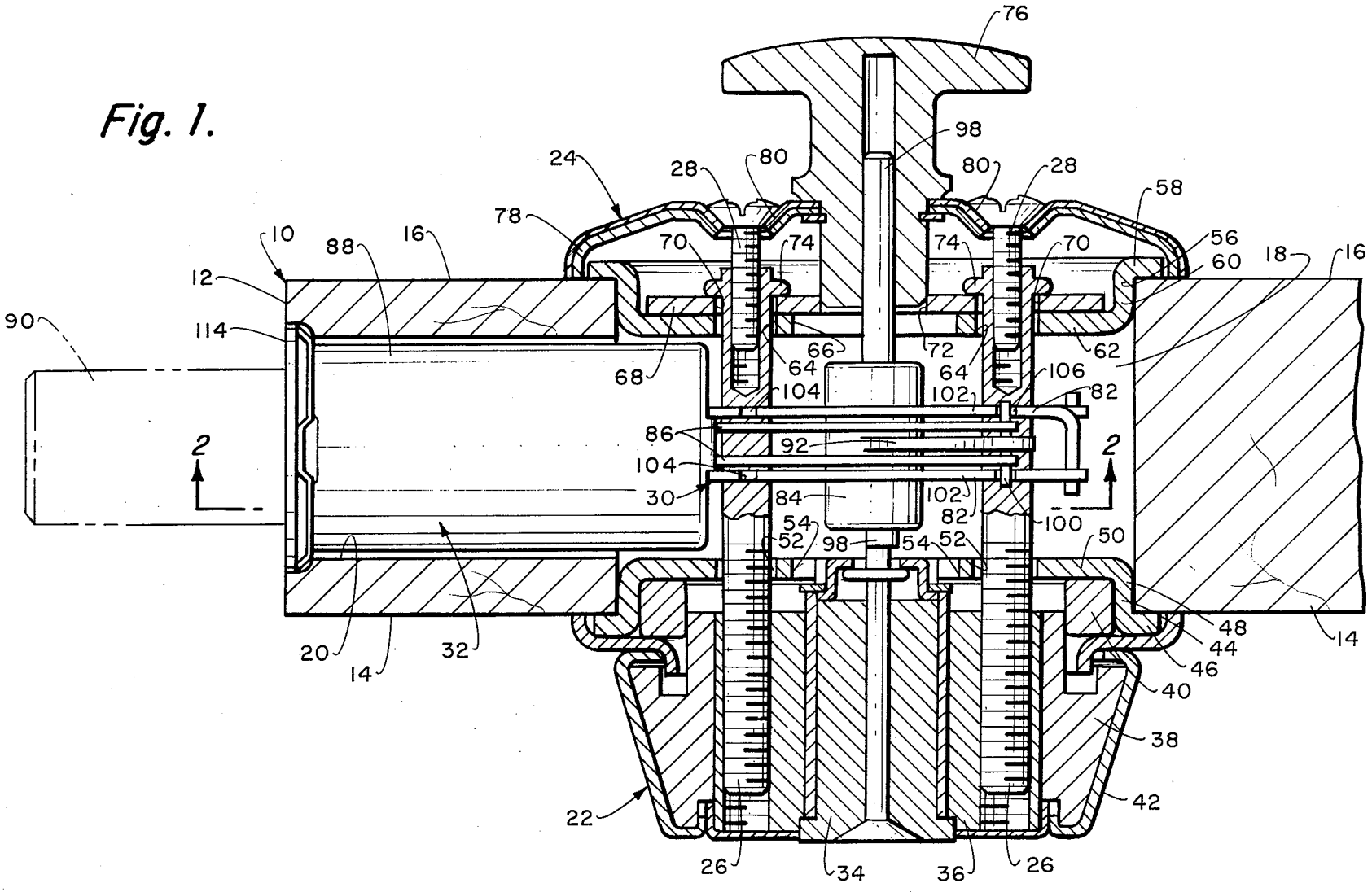
FIG. 1 is a horizontal sectional view of a first preferred embodiment of the latch construction of the present invention installed in a fragmentary section of a typical door, the latch construction being shown with the bolt thereof in retracted position, the bolt extended position being illustrated in phantom lines.

Referring to FIGS. 1 through 5 of the drawings, a first preferred embodiment of the latch construction of the present invention is shown and is generally of the dead bolt type. Furthermore, the latch construction is illustrated installed in a typical door generally indicated at 10, the door having a usual vertical door edge 12 extending between usual vertical exterior and interior door faces 14 and 16, respectively. A latch circular hole 18 is formed through the door 10 between the exterior and interior door faces 14 and 16, and is joined by a bolt circular hole 20 extending from the latch hole at right angles through the door edge 12 in usual fashion.

Generally, the latch construction includes an exterior operator assembly generally indicated at 22, and interior operator assembly generally indicated at 24, fastening means preferably in the form of pairs of primary and secondary fasteners 26 and 28, a latch driving mechanism generally indicated at 30 and a bolt assembly generally indicated at 32. The latch construction may be formed of conventional materials and by conventional manufacturing procedures as normally practiced in the industry.

Specifically to the exterior operator assembly 22, a lock cylinder 34 is rotatably mounted in a telescoping lock frame 36 which, in turn, is telescoped by an exterior guard collar 38. An inner end portion of the exterior guard collar 38 is partially telescoped by an exterior guard ring 40, and the entire described assembly is finally outwardly appropriately telescoped by a surrounding, three piece, annular cover 42.

Important to certain of the improved anti-violation features of the present invention, the exterior operator assembly 22 also includes a circular, preferably inwardly dished, exterior reinforcing plate 44 having an edge portion 46 abutting the exterior door face 14 preferably completely around the periphery of the latch circular hole 18 of the door 10. Inwardly of the edge portion 46, a short transverse annular portion 48 of the exterior reinforcing plate 44 closely conforms to the door 10 preferably again abutting the door within the latch circular hole 18 with a central portion 50 spanning the latch circular hole spaced inwardly thereof and completing the plate dished configuration. The central portion 50 of the exterior reinforcing plate 44 is formed with appropriate spaced fastener openings 52 and a center operator opening 54, otherwise effectively closing the exterior end of the latch circular hole 18 of the door 10.

Thus, in the assembly of the latch construction, the exterior reinforcing plate 44 forms an exterior closure for the latch circular hole 18 of the door 10 within and against which the remainder of the exterior operator assembly 22 is mounted. As shown in FIG. 1, the remainder of the exterior operator assembly 22 inwardly abuts the exterior reinforcing plate 44 retaining such plate in its mounted position by effectively inwardly abutting the plate edge portion 46 as well as inwardly abutting an annular portion of the plate central portion 50. With the outer extremities of the cover 42 overlying the plate edge portion 46 as shown, the exterior reinforcing plate 44 not only provides a quite strong rigid mount for the remainder of the exterior operator assembly 22, but also forms a strong rigid protection for the interior of the latch circular hole 18 and the latch driving mechanism 30 mounted therein including the portions of the primary fasteners 26 passing therethrough as will be hereinafter described.

The interior operator assembly 24 preferably includes a substantially identical interior reinforcing plate 56, that is, having an edge portion 58 abutting the interior door face 16, a transverse annular portion 60 inwardly along the latch circular hole 18 and a central portion 62 completing the spanning of the latch circular hole and having the same fastener and operator openings 64 and 66 therethrough. As a supplementary part to the interior reinforcing plate 56, a backing plate 68 may be received in the dishing recess of the interior reinforcing plate from exteriorly thereof and abutting the central portion 62. As shown, the backing plate 68 has identical fastener openings 70 therethrough and a reduced size operator opening 72 therethrough, the latter being of reduced size for a purpose to be hereinafter explained.

Without regard for the moment to the remainder of the interior operator assembly 24, the primary fasteners 26 preferably in the form of primary fastening screws are inserted transversely through the fastener opening 70 of the backing plate 68, through the fastener opening 64 of the interior reinforcing plate 56, through the latch driving mechanism 30 as will be hereinafter more clearly explained, through the fastener openings 52 of the exterior reinforcing plate 44, and are finally threadably received in the lock frame 36 of the exterior operator assembly 22. These primary fasteners 26 are threaded into the lock frame 36 of the exterior operator assembly 22 until heads 74 thereof are drawn into tight abutting engagement with the interior reinforcing plate 56, in this case through the backing plate 68 which, in turn, draws the entire of the exterior operator assembly 22 including the exterior reinforcing plate 44 into proper assembly tightly abutting the exterior door face 14 and supported thereby. This means that the entire of the exterior operator assembly 22 is secured assembled against the exterior door face 14 by the interior reinforcing plate 56 which provides extremely secure fastening and retainment therefor and likewise secure retainment for the exterior reinforcing plate 44 of this assembly. With the particular described relationship of the exterior reinforcing plate 44 closing the exterior of the latch circular hole 18 inwardly of and underlying the remainder of the exterior operator assembly 22, this further means that the exterior reinforcing plate 44 strongly held in place by the interior reinforcing plate 56 serves as quite efficient anti-violation means frustrating attempts at penetration into the latch circular hole 18 and against both the interior portions of the primary fasteners 26 and the latch driving mechanism 30.

The interior operator assembly 24 of this first embodiment of the latch construction of the present invention is completed by a hand interior operator 76 rotatably mounted extending partially centrally through a multi-layer cover 78, which cover telescopes the interior reinforcing plate 56 and preferably abuts the interior door face 16. Since the interior operator 76 is a hand operator, the cover 78 is sufficient for supporting the same and the inner extremity of the hand interior operator preferably projects partially into the operator opening 72 of the backing plate 68 closely rotatably conforming to this reduced size operator opening. The hand interior operator 76 and the cover 78 are secured in their assembled positions by the secondary fasteners 28 in the form of secondary fastening screws received through appropriate fastener openings 80 of the cover and into endwise coaxial threadable engagement with the primary fasteners 26 as can be clearly seen in FIG. 1. Note, however, that the initial securement of the exterior operator assembly 22 including the exterior reinforcing plate 44 with the interior reinforcing plate 56 of the interior operator assembly 24 is, in effect, completely independent, particularly for its anti-violation fastening strength purposes, from the securement of the hand interior operator 76 and the cover 78, the primary fasteners 26 serving the prime securement purposes and the secondary fasteners 28 engaging the primary fasteners for the lesser strength securement of the hand interior operator 76 and the cover 78.

Figure 2:
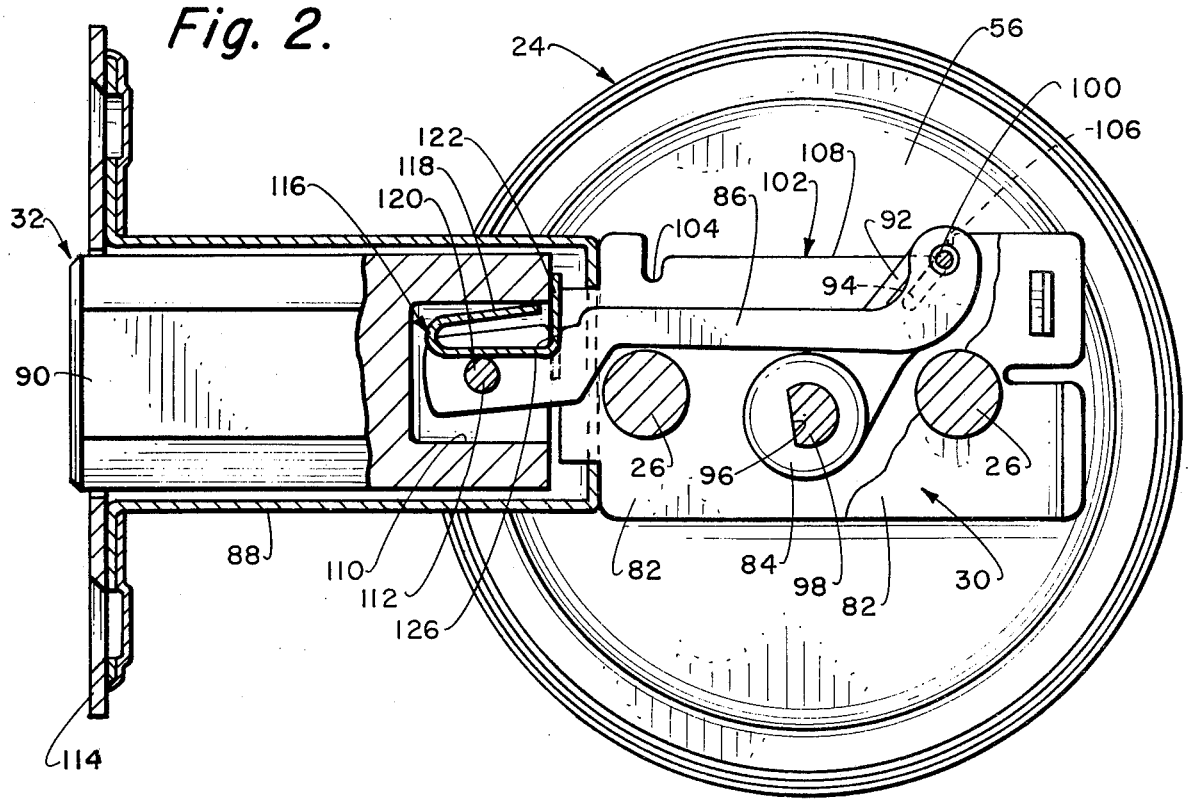
FIG. 2 is a vertical sectional view of the latch construction of FIG. 1 looking in the direction of the arrows 2—2 in FIG. 1, but with the latch construction removed from the door.
Figure 3:
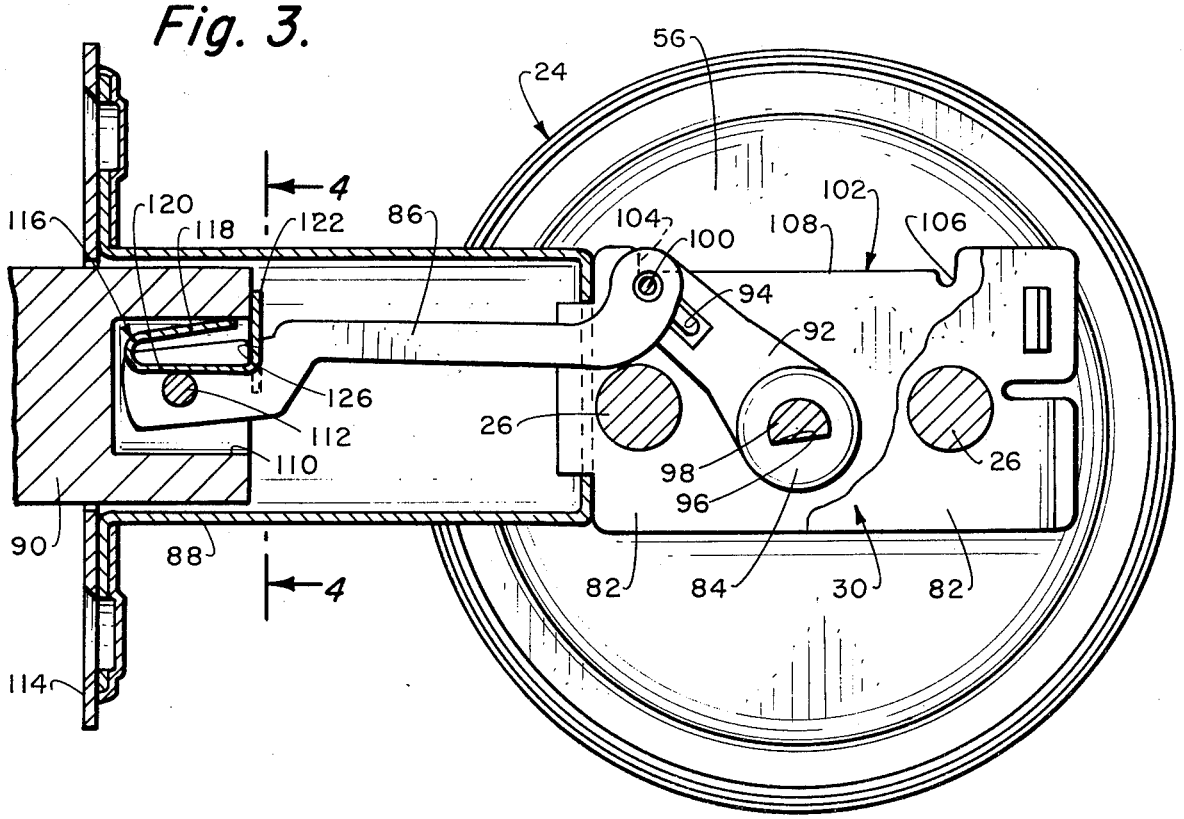
FIG. 3 is a fragmentary, vertical sectional view similar to FIG. 2, but with the bolt in fully extended position.

Referring for the moment to FIGS. 1, 2 and 3, the latch driving mechanism 30 includes a pair of longitudinally extending latch frame members 82, a rotatable driving member 84 and a pair of longitudinally extending driving levers 86, while the bolt assembly 32 includes a hollow cylindrical bolt housing 88 telescoping a longitudinally reciprocal, cylindrical bolt 90. In somewhat usual manner, the latch driving mechanism 30 is positioned in the central part of the latch circular hole 18 between the exterior and interior operator assemblies 22 and 24 operably connected thereto as will be hereinafter described. The bolt assembly 32 is for the main part within the bolt circular hole 20 with the bolt housing 88 opening rearwardly into the latch driving mechanism 30 and opening forwardly through the door edge 12.

More specifically, the latch frame members 82 are transversely spaced, secured together rearwardly as shown and forwardly secured to the bolt housing 88. The entire of the latch driving mechanism 30 is retained in the overall latch construction assembly by the primary fasteners 26 being received transversely through the latch frame members 82. Furthermore, the driving member 84 is rotatably supported also extending transversely through the latch frame members 82 with a radially projecting portion 92 located between the latch frame members and having a drive slot 94 transversely therethrough. The driving member 84 is operably connected to the exterior and interior operator assemblies 22 and 24 by a D-shaped opening 96 receiving and rotatably engaging a drive shaft or shafts 98 of the lock cylinder 34 and the hand interior operator 76 as shown.

The driving levers 86 are positioned transversely between the latch frame members 82 and are also transversely spaced with the rearward ends thereof sandwiching the projecting portion 92 of the driving member 84 therebetween. A transverse drive pin 100 is rotatably received through the rearward ends of the driving levers 86 as well as through the drive slot 94 of the driving member 84. As best seen in FIGS. 2 and 3, upwardly open guide slots generally indicated at 102 are formed transversely aligned at upper extremities of the latch frame members 82, each guide slot terminating forwardly in a vertically downward forward slot portion 104, terminating rearwardly in a vertically downward rearward slot portion 106 with a relatively flat, longitudinally extending guide surface portion therebetween. Extending ends of the drive pin 100 project transversely over the guide slots 102 with the drive pins being urged downwardly against the described portions thereof in a manner to be hereinafter described.

The driving levers 86 project forwardly from the driving member 84 overlying both the primary fasteners 26 and the driving member 84 with the forward ends of the driving levers 86 being pivotally connected to the rearward end of the bolt 90 by reception in a rearwardly opening bolt cavity 110 and pivotally receiving a transverse pivot pin 112 end secured in the bolt. The forward extremity of the bolt housing 88 is secured to the door edge 12 by a usual mounting plate 114 and with the bolt 90 longitudinally slideable in the bolt housing 88, the bolt may be longitudinally reciprocated between extended and retracted positions by the latch driving mechanism 30 through the driving levers 86. The retracted position of the various elements including the bolt 90 is shown in FIGS. 1 and 2, and the extended position thereof is shown in phantom lines in FIG. 1 and in full lines in FIG. 3, the bolt in extended position engaging in a usual door jamb strike plate (not shown).

Figures 4, 5, 6:
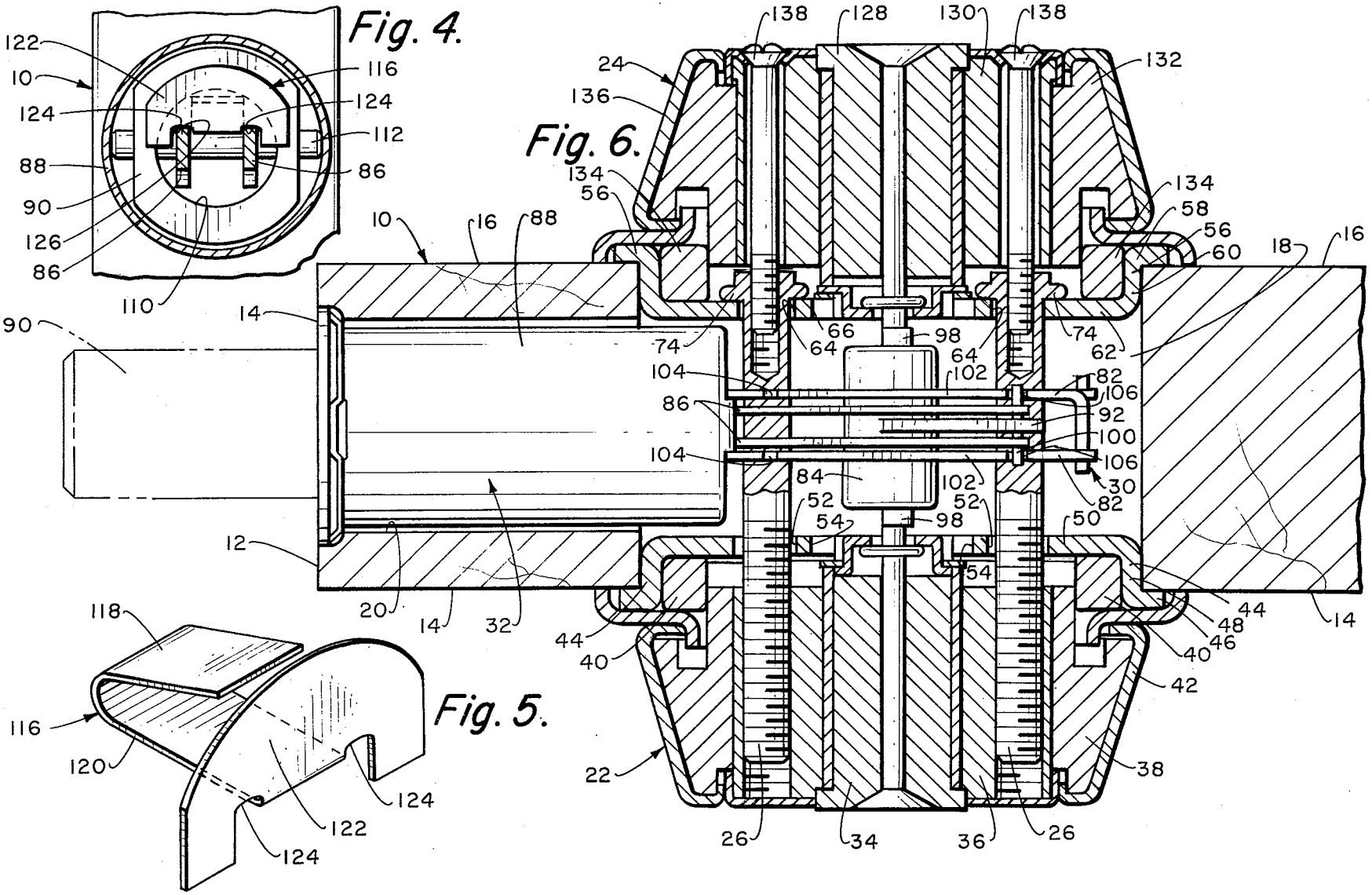
FIG. 4 is a fragmentary, vertical sectional view looking in the direction of the arrows 4—4 in FIG. 3.
FIG. 5 is an enlarged, elevational view of the dead bolt dogging spring taken from the latch construction assembly of FIGS. 1 through 4.
FIG. 6 is a view similar to FIG. 1, but of a second preferred embodiment of the latch construction of the present invention.

More important to the principles of the present invention, a unique compression spring generally indicated at 116 is positioned primarily within the bolt cavity 110 generally overlying the forward ends of the driving levers 86 as best seen in assembly in FIGS. 2, 3 and 4, and removed from assembly in FIG. 5. The compression spring 116 is generally C-shaped in configuration, that is, the C-shape opening rearwardly, with an upper leg 118 bearing resiliently upwardly against the bolt 90 within the bolt cavity 110 transversely between the forward ends of the driving levers 86. A lower leg 120 of the compression spring 116 extends rearwardly overlying and preferably downwardly abutting the pivot pin 112 between the driving levers 86 and terminates rearwardly just outwardly of the bolt cavity 110 and rearward end of the bolt 90 in a generally vertical plate portion 122 which projects transversely oppositely over the driving levers 86. The spring plate portion 122 forms downwardly opening slots 124 transversely outwardly adjacent the main part of the spring lower leg 120 and vertically downwardly aligned, the driving levers 86 form upwardly opening slots 126 so that downward engagement of the spring plate portion 122 with the driving levers 86 engages the driving levers in the plate portion slots 124 and at the same time, engages the spring plate portion 122 downwardly in the driving lever slots 126 so as to insure secure retention of the compression spring 116 in the described assembly.

With the engagement of the lower leg 120 on compression spring 116 downwardly against the driving levers 86 spaced rearwardly of the driving lever pivotal connections with the bolt 90 through the pivot pin 112, the effect of the compression spring 116 is to very efficiently constantly downwardly urge the driving levers in their vertical pivoting about the rearward end of the bolt 90 which, in turn, constantly downwardly urges the rearward ends of the driving levers and the drive pin 100 connected to these driving lever rearward ends. This most importantly means that the drive pin 100 is always downwardly resiliently urged against the lower surfaces of the guide slots 102 in the latch frame members 82. Thus, when the bolt 90 is in its retracted position as shown in FIGS. 1 and 2, the driving lever drive pin 100 is urged downwardly into the rearward slot portion 106 of the guide slots 102, and as the bolt moves toward extended position, the drive pin slides along the guide surface portion 108. More important, when the bolt 90 reaches fully extended position as shown in FIG. 3, the drive pin 100 is urged and received downwardly in the forward slot portion 104 of the guide slots 102, the compression spring 116 firmly retaining the drive pin so engaged and through the driving levers 86 resisting any attempted rearward driving of the bolt from this fully extended position, again, improved anti-violation protection.

In general operation of the first embodiment of the latch construction of the present invention, starting from the retracted position of the bolt 90 as shown in FIGS. 1 and 2, counterclockwise rotation of either the lock cylinder 34 of the exterior operator assembly 22 or the hand interior operator 76 of the interior operator assembly 24 rotates the projecting portion 92 of the driving member 84 forwardly moving the driving levers 86 forwardly to move the bolt 90 toward the extended position as shown in FIG. 3. During this movement, the drive pin 100 is first urged and moved upwardly out of the rearward slot portion 106 of the guide slots 102 and then along the guide surface portion 108 thereof, the compression spring 116 always retaining this drive pin resiliently urged tightly against the lower surfaces of the guide slots. Ultimately, the forward movement of the driving levers 86 fully extends the bolt 90 as shown in phantom lines in FIG. 1 and full lines in FIG. 3 with the drive pin 100 arriving at and being resiliently urged positively downwardly into the forward slot portions 104 of the guide slots 102 so as to resist rearward driving of the bolt 90 by an outside force from this fully extended position. Movement of the bolt 90 from extended back to its retracted position is merely a reverse of the foregoing, that is, a clockwise rotation of either the lock cylinder 34 of the exterior operator assembly 22 or the hand interior operator 76 of the interior operator assembly 24.

As can be readily determined from the various positions of the elements in FIGS. 2 and 3, there is no difficulty in moving the drive pin 100 into and from either of the forward and rearward slot portions 104 and 106 of the guide slots 102 during the intended movement of the driving member 84 by the exterior or interior operator assemblies 22 or 24. At the same time, however, when this drive pin 100 is resiliently urged into and finally located in the forward slot portions 104 of the guide slots 102, due to the direct rearward forces through the driving levers 86, it is impossible to dislodge this drive pin 100 from the forward slot portions 104 by a direct driving through the bolt 90 from an outside force.

The second embodiment of the latch construction of the present invention shown in FIG. 6 is in all respects essentially identical to the first embodiment form with the exception of the hand interior operator 76 and the cover 78 shown in FIG. 1 being directly replaced by an interior lock cylinder 128, an interior lock frame 130, an interior guard collar 132, an interior guard ring 134 and a three piece interior cover 136. These various new interior elements are assembled in the identical manner to the similar exterior elements of the exterior operator assembly 22 as hereinbefore described and are secured in assembly against the same interior reinforcing plate 56 by screw-type secondary fasteners 138 threadably received in the ends of the primary fasteners 26 as before. In other words, the securement of the exterior operator assembly 22 by the primary fasteners 26 engaged with the interior reinforcing plate 56 remains identically the same with only the remaining elements of the interior operator assembly 24 being converted to a lock-type form, thereby illustrating the versatility of the latch construction of the present invention.

According to the principles of the present invention, therefore, a latch construction is provided having improved anti-violation features over prior similar constructions. By direct securement of the entire of the exterior operator assembly 22 with the interior reinforcing plate 56 through the primary fasteners 26 and without regard to type or fastening of the remainder of the interior operator assembly 24, positive securement of the exterior operator assembly 22 is always assured and does not depend on any shapes or strength factors of the interior operator assembly 24. At the same time, installation of the exterior reinforcing plate 44 as an integral part of the exterior operator assembly 22 augments this secure fastening of the exterior operator assembly as well as provides additional anti-violation protection for the interior of the latch construction. Separate from or in addition to all of the foregoing, a further anti-violation improvement is provided by the unique and positively operable compression spring 116 which insures absolute retention of the bolt 90 in its fully extended position and against forces applied externally of the bolt attempting to drive the same from extended toward retracted position.

I claim:

1. In a latch construction of the type for mounting in doors and the like with a bolt extendable from a door edge, a latch driving mechanism mounted within the door operably connected to said bolt movable for moving said bolt between extended and retracted positions, an exterior operator assembly projecting outwardly from an exterior door face at a transverse opening through the door including a lock frame mounting a lock cylinder telescoped by a surrounding annular cover inwardly abutting said exterior door face around said door opening, an interior operator assembly projecting outwardly from an interior door face at said door opening including an interior operator and an annular cover inwardly abutting said interior door face around said door opening, said lock cylinder of said exterior operator assembly and interior operator of said interior operator assembly being operably connected to said latch driving mechanism for selectively moving said latch driving mechanism, and fastening means engaged between said lock frame of said exterior operator assembly and said interior operator assembly retaining assembly of said exterior and interior operator assemblies with said latch driving mechanism and said door; the improvements comprising: said interior operator assembly further including a separate interior reinforcing plate transversely spanning said door opening and edge abutting said interior door face; said fastening means including primary fasteners operably engaged with said interior reinforcing plate securing said lock frame of said exterior operator assembly directly to said interior reinforcing plate, secondary fasteners directly engaged with ends of said primary fasteners and operably engaged with both said interior operator and said cover of said interior operator assembly securing said interior operator and said cover directly to said primary fasteners.

2. In a latch construction as defined in claim 1 in which said cover of said interior operator assembly is directly secured to said primary fasteners by said secondary fasteners, said interior operator being rotatably mounted on said cover of said interior operator assembly secured to said primary fasteners by said cover.

3. In a latch construction as defined in claim 1 in which said primary fasteners of said fastening means are primary screws threadably engaged with said lock frame of said exterior operator assembly and operably engaged with said interior reinforcing plate of said interior operator assembly, said secondary fasteners of said fastening means being secondary screws threadably engaged in ends of said primary screws and engaged with said cover of said interior operator assembly; and in which said interior operator of said interior operator assembly is rotatably connected to said cover of said interior operator assembly operably secured to said primary screws by said cover.

4. In a latch construction as defined in claim 1 in which said interior operator assembly includes a lock frame mounting a lock cylinder and forming said interior operator, said cover at least radially telescoping said lock frame, said lock frame being secured to said primary fasteners by said secondary fasteners of said fastening means.

5. In a latch construction as defined in claim 1 in which said interior operator assembly includes a lock frame mounting a lock cylinder and forming said interior operator, said cover at least radially telescoping said lock frame; and in which said primary fasteners of said fastening means are primary screws threadably engaged with said lock frame of said exterior operator assembly and operably engaged with said interior reinforcing plate of said interior operator assembly, said secondary fasteners of said fastening means being secondary screws threadably engaged in ends of said primary screws and operably engaged with said lock frame of said interior operator assembly, said cover of said interior operator assembly being secured telescoping said lock frame of said interior operator assembly by operable connection of said cover to said secondary screws.

6. In a latch construction as defined in claim 1 in which said exterior operator assembly includes a separate exterior reinforcing plate transversely spanning said door opening between an interior of said door opening and said lock frame and edge abutting said exterior door face, a part of said exterior operator assembly inwardly abutting said exterior reinforcing plate during securement of said lock frame of said exterior operator assembly to said interior reinforcing plate by said primary fasteners of said fastening means.

7. In a latch construction as defined in claim 1 in which said exterior operator assembly includes a separate exterior reinforcing plate transversely spanning said door opening between an interior of said door opening and said lock frame and edge abutting said exterior door face, a part of said exterior operator assembly inwardly abutting said exterior reinforcing plate during securement of said lock frame of said exterior operator assembly to said interior reinforcing plate by said primary fasteners of said fastening means; and in which said cover of said interior operator assembly is directly secured to said primary fasteners by said secondary fasteners, said interior operator being rotatably mounted on said cover of said interior operator assembly secured to said primary fasteners by said cover.

8. In a latch construction as defined in claim 1 in which said exterior operator assembly includes a separate exterior reinforcing plate transversely spanning said door opening between an interior of said door opening and said lock frame and edge abutting said exterior door face, a part of said exterior operator assembly inwardly abutting said exterior reinforcing plate during securement of said lock frame of said exterior operator assembly to said interior reinforcing plate by said primary fasteners of said fastening means; and in which said interior operator assembly includes a lock frame mounting a lock cylinder and forming said interior operator, said cover at least radially telescoping said lock frame, said lock frame being secured to said primary fasteners by said secondary fasteners of said fastening means.

9. In a latch construction as defined in claim 1 in which said exterior operator assembly includes a separate exterior reinforcing plate transversely spanning said door opening between an interior of said door opening and said lock frame and edge abutting said exterior door face, a part of said exterior operator assembly inwardly abutting said exterior reinforcing plate during securement of said lock frame of said exterior operator assembly to said interior reinforcing plate by said primary fasteners of said fastening means; and in which each of said interior and exterior reinforcing plates includes a substantially circular and inwardly dished reinforcing plate.

10. In a latch construction of the type having a longitudinally slideable reciprocal bolt movable forwardly and rearwardly into extended and retracted positions by a generally longitudinally extending driving lever, a forward end of said driving lever being pivotally connected to said bolt within a rearwardly opening bolt cavity pivotal upwardly and downwardly about a transverse axis, a driving member rotatable about a transverse axis having a generally radially extending and transversely opening driving slot formed therein, a transverse driving pin through a rearward end of said driving lever and through said driving member driving slot slideable along said driving slot, said driving pin in transverse extension also being slideable along a guide surface formed transversely of a latch frame member, said guide surface having a longitudinally extending portion terminating at least forwardly in a generally downwardly projecting end slot, said driving pin sliding along said guide surface longitudinally extending portion during reciprocal movement of said bolt by rotation of said driving member and moving downwardly into said guide slot at said forward end when said bolt is moved fully into its extended position; the improvements comprising: a rearwardly opening C-shaped spring primarily in said bolt cavity resiliently vertically compressed upwardly against said bolt and downwardly against said driving lever forward end spaced rearwardly of said pivotal connection of said driving lever to said bolt to constantly resiliently urge said driving lever pivotally downwardly relative to said bolt and said driving pin downwardly against said guide surface.

11. In a latch construction as defined in claim 10 in which said spring has a lower leg terminating rearwardly in an end vertical portion received downwardly in a slot of said driving lever forward end spaced rearwardly of said pivotal connection of said driving lever to said bolt.

12. In a latch construction as defined in claim 10 in which said spring has a lower leg terminating rearwardly in an end vertical portion, said end vertical portion having a downwardly opening groove formed therein and received over said driving lever forward end spaced rearwardly of said pivotal connection of said driving lever to said bolt.

13. In a latch construction as defined in claim 10 in which said forward end of said driving lever is pivotally connected to said bolt by a bolt pivot pin extending transversely through said bolt cavity; and in which said spring downwardly engages said bolt pivot pin intermediate a lower leg of said spring.

14. In a latch construction as defined in claim 10 in which said forward end of said driving lever is pivotally connected to said bolt by a bolt pivot pin extending transversely through said bolt cavity; and in which said spring has a lower leg terminating rearwardly in an end vertical portion, said end vertical portion having a downwardly opening groove formed therein, said end vertical portion engaging over said driving lever receiving said driving lever in said groove with said end vertical portion engaging downwardly in a groove of said driving lever outwardly of said bolt cavity, said spring lower leg downwardly engaging said bolt pivot pin within said bolt cavity.

15. In a latch construction as defined in claim 10 in which said latch construction includes two transversely spaced driving levers identically connected and identically operable; and in which said spring is mounted transversely between forward ends of said driving levers and has a lower leg terminating rearwardly in an end vertical portion engaging transversely over said driving levers spaced rearwardly of pivotal connection of said driving levers to said bolt.

16. In a latch construction as defined in claim 10 in which said latch construction includes two transversely spaced driving levers identically connected and identically operable; and in which said spring is mounted transversely between forward ends of said driving levers and has a lower leg terminating rearwardly in an end vertical portion, said end vertical portion extending oppositely transversely over said driving levers spaced rearwardly of pivotal connection of said driving levers to said bolt and being received downwardly in grooves of said driving levers.

17. In a latch construction as defined in claim 10 in which said latch construction includes two transversely spaced driving levers identically connected and identically operable; in which forward ends of said driving levers are pivotally connected to said bolt by a bolt pivot pin extending transversely through said bolt cavity; and in which said spring is mounted transversely between said forward ends of said driving levers and has a lower leg terminating rearwardly in engagement over said driving levers spaced rearwardly of pivotal connection of said driving levers to said bolt, said spring downwardly engaging said bolt pivot pin intermediate said spring lower leg.

18. In a latch construction as defined in claim 10 in which said latch construction includes two transversely spaced driving levers identically connected and identically operable; in which forward ends of said driving levers are pivotally connected to said bolt by a bolt pivot pin extending transversely through said bolt cavity; and in which said spring is mounted transversely between said forward ends of said driving levers and has a lower leg terminating rearwardly in an end vertical portion projecting transversely oppositely over said driving levers spaced rearwardly of said driving lever pivotal connection to said bolt by said bolt pivot pin, said end vertical portion having downwardly opening grooves formed therein receiving said driving levers therein and while said end vertical portion is simultaneously engaged downwardly in grooves of said driving levers, said spring lower leg downwardly engaging said bolt pivot pin intermediate said spring lower leg.

* * * * *